US008196951B2

(12) United States Patent
Blakeman

(10) Patent No.: US 8,196,951 B2
(45) Date of Patent: Jun. 12, 2012

(54) PERSONALIZABLE SPORTS THEMED ICE CHEST, AND METHODS OF CONSTRUCTING AND UTILIZING SAME

(76) Inventor: Ken Blakeman, Las Vegas, NV (US)

( * ) Notice: Subject to any disclaimer, the term of this patent is extended or adjusted under 35 U.S.C. 154(b) by 376 days.

(21) Appl. No.: 12/573,104

(22) Filed: Oct. 3, 2009

(65) Prior Publication Data

US 2011/0056230 A1 Mar. 10, 2011

Related U.S. Application Data

(63) Continuation-in-part of application No. 29/343,089, filed on Sep. 7, 2009, now Pat. No. Des. 613,128.

(51) Int. Cl.
*B62B 5/00* (2006.01)

(52) U.S. Cl. ..... 280/655; 280/30; 280/47.26; D7/606

(58) Field of Classification Search ..... 280/87.043, 280/30, 79.2, 655, 47.26; 600/500, 323, 600/324; 62/457.7, 331; D7/604, 606, 514, D7/529

See application file for complete search history.

(56) References Cited

U.S. PATENT DOCUMENTS

| | | | | |
|---|---|---|---|---|
| D231,523 | S | 4/1974 | Baker | |
| 4,164,284 | A | 8/1979 | Witt et al. | |
| 4,513,895 | A * | 4/1985 | Leslie | D7/607 |
| D349,008 | S | 7/1994 | Minor | |
| D349,009 | S | 7/1994 | Minor | |
| D349,629 | S * | 8/1994 | Redmon | D7/606 |
| D349,630 | S * | 8/1994 | Redmon | D7/606 |
| D349,631 | S * | 8/1994 | Redmon | D7/606 |
| D370,391 | S | 6/1996 | Bauer et al. | |
| D378,562 | S | 3/1997 | Miller et al. | |
| 5,803,472 | A | 9/1998 | Lien | |
| D401,117 | S | 11/1998 | Anderson et al. | |
| D409,050 | S | 5/1999 | Anderson et al. | |
| D452,120 | S | 12/2001 | Brangle et al. | |
| 6,474,097 | B2 * | 11/2002 | Treppedi et al. | 280/30 |
| 6,802,149 | B1 * | 10/2004 | Albanese et al. | 43/4 |
| D530,571 | S | 10/2006 | Hemann et al. | |
| D536,219 | S * | 2/2007 | Gearing | D7/606 |
| 7,387,608 | B2 * | 6/2008 | Dunlop et al. | 600/500 |
| 7,407,032 | B1 * | 8/2008 | Chambers et al. | 280/87.043 |
| 7,603,875 | B2 * | 10/2009 | Carr | 62/457.7 |
| 2002/0060438 | A1 * | 5/2002 | Gartner et al. | 280/79.2 |
| 2003/0168371 | A1 | 9/2003 | Weimer | |
| 2005/0279123 | A1 * | 12/2005 | Maldonado et al. | 62/457.7 |
| 2010/0263398 | A1 * | 10/2010 | Webb | 62/331 |

* cited by examiner

*Primary Examiner* — Hau Phan

(74) *Attorney, Agent, or Firm* — Weiner & Burt, P.C.; Irving M. Weiner; Pamela S. Burt

(57) ABSTRACT

A personalizable sports themed ice chest having a main ice chest housing and a selectively openable and closable lid member pivotably secured to the housing. The ice chest has a personalizable sports related shape, wheels rotatably secured to the housing, a collapsible pull handle mechanism connected to the housing, and areas on the housing and lid member for the placement of a logo or emblem.

20 Claims, 4 Drawing Sheets

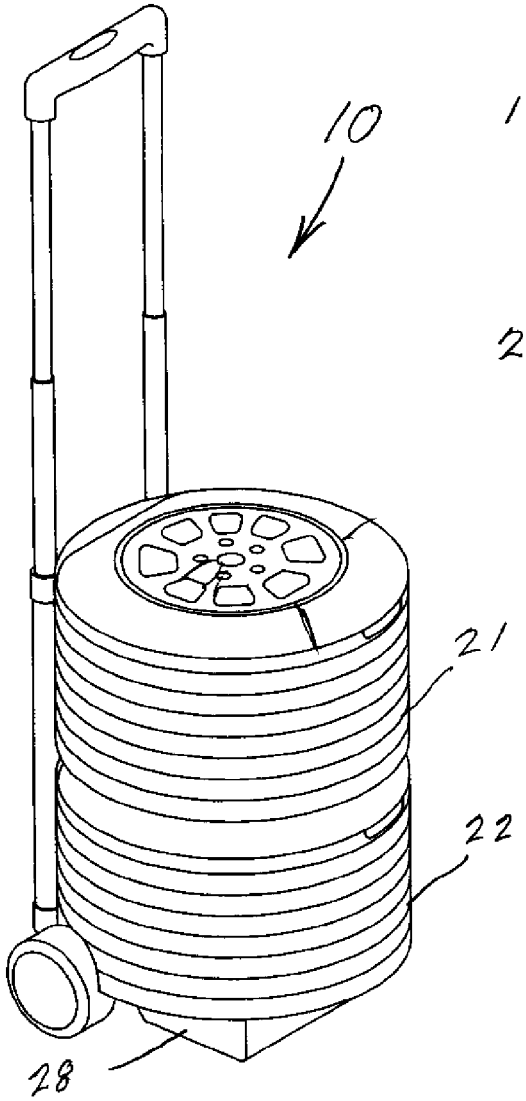
FIG. 1
FIG. 2
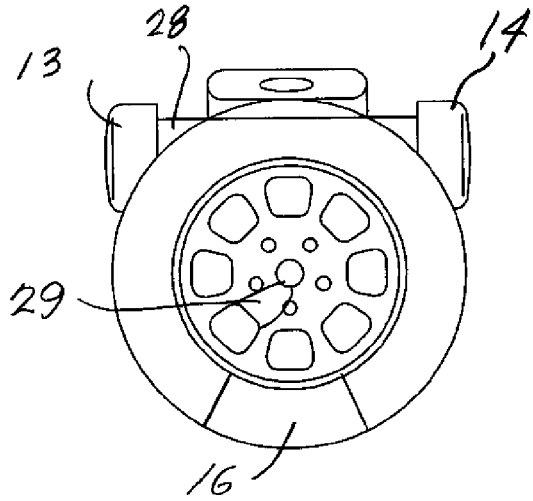
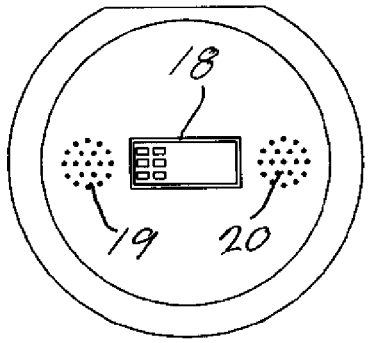
FIG. 3

15
28

12
15
21
22
10
14

17
28

12
11
13
28

PERSONALIZABLE SPORTS THEMED ICE CHEST, AND METHODS OF CONSTRUCTING AND UTILIZING SAME

CROSS-REFERENCE TO RELATED APPLICATIONS

This application is a continuation-in-part of and claims priority from US Design Pat. Application 29/343,089 filed Sep. 7, 2009 now U.S. Pat. No. DES.613,128.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The phrase "sports related shape" as used herein means any one of various sports related shapes, including, but not limited to, a football, a soccer ball, a baseball, a golf ball, a race car driver's helmet, stacked tires, and a football helmet.

The phrase "a renewable resource" as used herein means any renewable resource, including, but not limited to, corn sugar or a fibrous residue remaining after sugarcane or sorghum stalks are crushed to extract their juice.

The present invention relates to a novel and unique personalizable sports themed ice chest, and methods of constructing and utilizing same.

More particularly, the present invention relates to a novel and unique personalizable sports themed ice chest fabricated from a renewable resource, and methods of constructing and utilizing same.

It is a desideratum of the present invention to avoid the animadversions of conventional ice chests, and at the same time to provide a very convenient and unique personalizable sports themed ice chest.

SUMMARY OF THE INVENTION

The present invention provides a personalizable sports themed ice chest, comprising: a main ice chest housing having a selectively openable and closable lid member pivotably secured to said main ice chest housing; said main ice chest housing and said selectively openable and closable lid member being formed in a personalizable sports related shape; wheels rotatably secured to said main ice chest housing under said main ice chest housing to enable said personalizable sports themed ice chest to be rolled by a user of said personalizable sports themed ice chest; a collapsible pull handle mechanism connected to said main ice chest housing; and one or more predetermined areas for the placement thereon of a logo or emblem.

It is a primary object of the present invention to provide a personalizable sports themed ice chest.

Another object of the present invention is to provide a novel and unique personalizable sports themed ice chest fabricated from a renewable resource, and methods of constructing and utilizing same.

A further object of the present invention is to provide an ice chest as described above which includes a mini recorder within the lid compartment.

Yet another object of the present invention is to provide an ice chest as described above which includes speakers built into the ice chest lid.

Yet another object of the present invention is to provide an ice chest as described above which includes a collapsible pull handle mechanism connected to the main ice chest housing, and one or more predetermined areas on the main ice chest housing for the placement thereon of a personalizable logo or emblem.

Other objects, advantages, and features of the present invention will become apparent to those persons skilled in this particular area of technology and to other persons after having been exposed to the present patent application when read in conjunction with the accompanying patent drawings.

BRIEF DESCRIPTION OF THE DRAWINGS

FIG. 1 is a perspective view of a first embodiment of the present invention.

FIG. 2 is a top plan view of the apparatus depicted in FIG. 1.

FIG. 3 shows the underside of the lid.

DETAILED DESCRIPTION OF THE INVENTION

Figure 4:
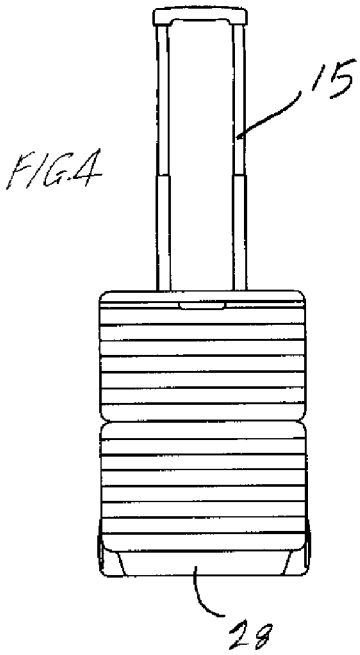
FIG. 4 is a front elevational view of the FIG. 1 apparatus.
Figure 5:
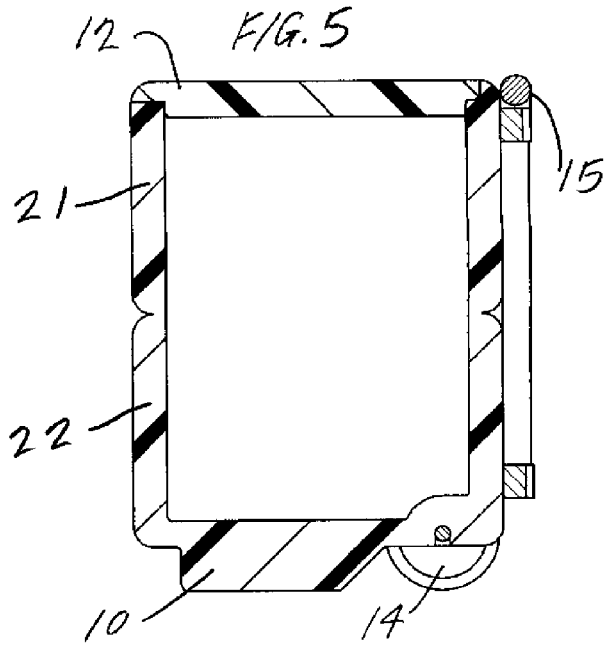
FIG. 5 is a cross-sectional view of the apparatus with the handle fully collapsed.
Figure 6:
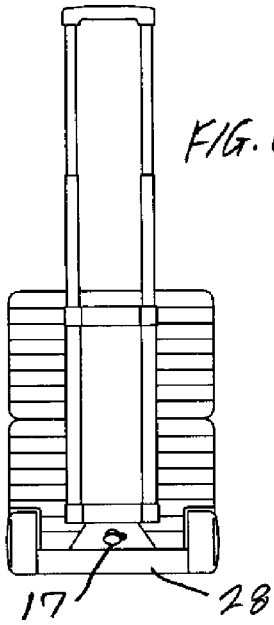
FIG. 6 is a rear elevational view of the FIG. 1 apparatus.
Figure 7:
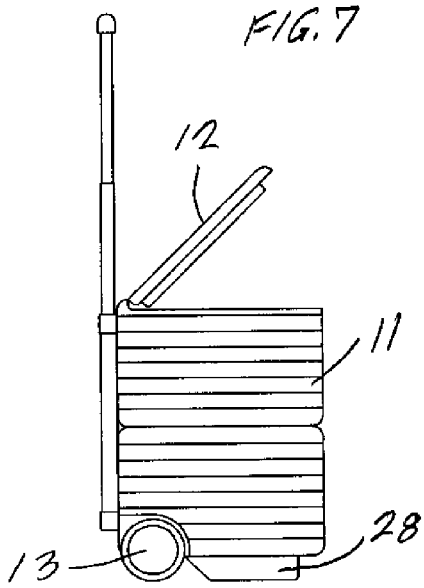
FIG. 7 is a side elevational view with the lid partially open.

With reference to FIGS. 1-7, there is shown a personalizable sports themed ice chest 10 in accordance with a first embodiment of the invention.

The chest 10 includes a main ice chest housing 11 having a selectively openable and closable lid member 12 pivotably secured to the main ice chest housing 11.

The main ice chest housing 11 and said selectively openable and closable lid member 12 are formed in a personalizable sports related shape, which in this case are stacked tires 21 and 22 for a user interested in the sport of auto racing.

Wheels 13 and 14 rotatably secured to said main ice chest housing 11 under said main ice chest housing 11 to enable said personalizable sports themed ice chest 10 to be rolled by a user of said personalizable sports themed ice chest 10.

As best seen in FIGS. 1, 4, 6 and 7, there is provided a supporting stand member 28 unitary with housing 11.

A collapsible pull handle mechanism 15 is connected to said main ice chest housing 11.

There are provided one or more predetermined areas 16 and 29 for the placement thereon of a personalizable logo or emblem (not shown).

Fabrication may be of standard commercially-available ice chest material.

Alternatively, the main ice chest housing 11, the selectively openable and closable lid member 12, the handle 15, the wheels 13 and 14, insulation and other components may be fabricated from a renewable resource.

More particularly, the main ice chest housing 11 and said selectively openable and closable lid member 12 may be fabricated from a renewable resource, for example, such as corn sugar or a fibrous residue remaining after sugarcane or sorghum stalks are crushed to extract their juice.

A drain 17 is provided at the bottom of said main ice chest housing 11.

A digital recorder 18 may be provided on the underside of said selectively openable and closable lid member 12.

The digital recorder 18 may be provided with preset messages and the ability for the user of said personalizable sports themed ice chest 10 to record additional messages on said digital recorder 18.

One or more speakers 19 and 20 may be provided on the underside of said selectively openable and closable lid member 12.

Figure 8:
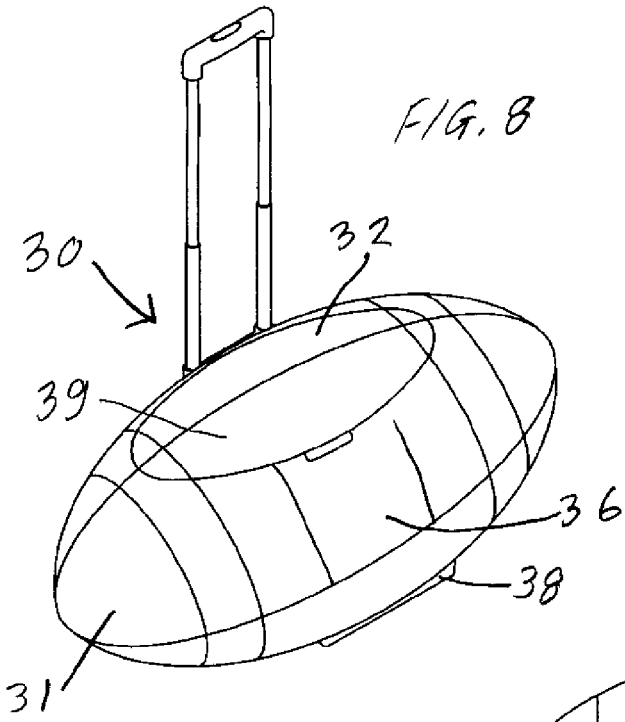
FIG. 8 is a perspective view of a second embodiment of the present invention.
Figure 9:
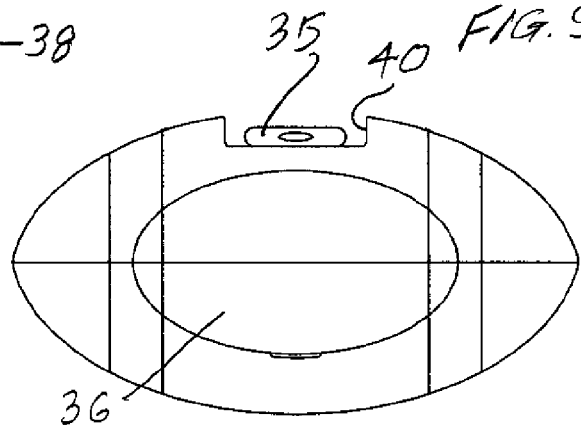
FIG. 9 is a top plan view of the FIG. 8 apparatus.
Figure 10:
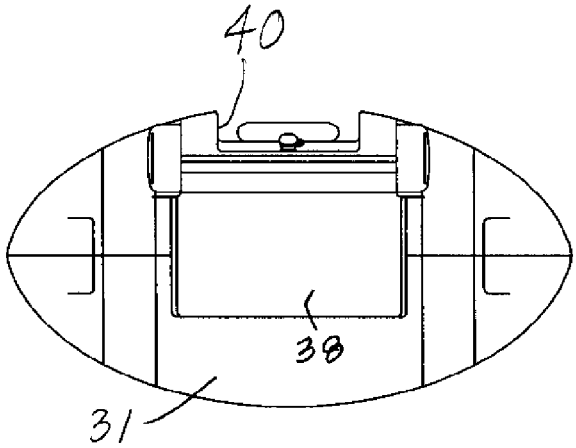
FIG. 10 is bottom view of the FIG. 8 apparatus.
Figure 11:
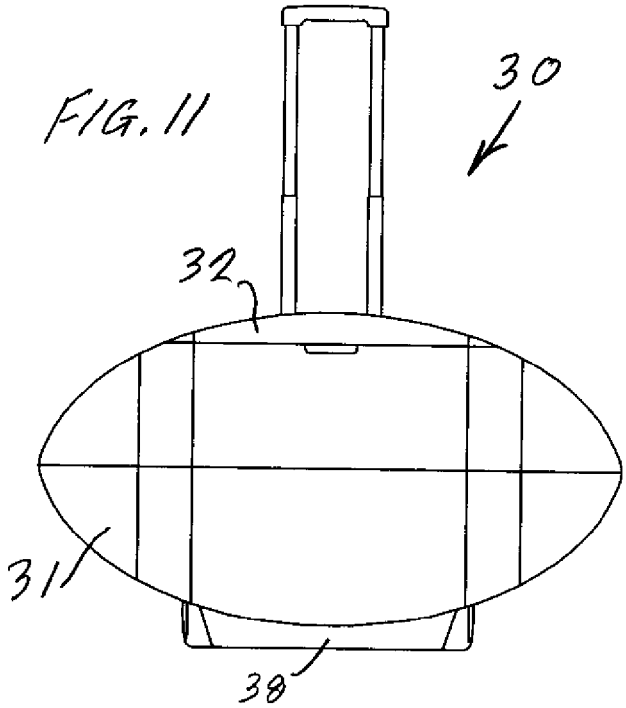
FIG. 11 is front elevational view of the FIG. 8 apparatus.
Figure 12:
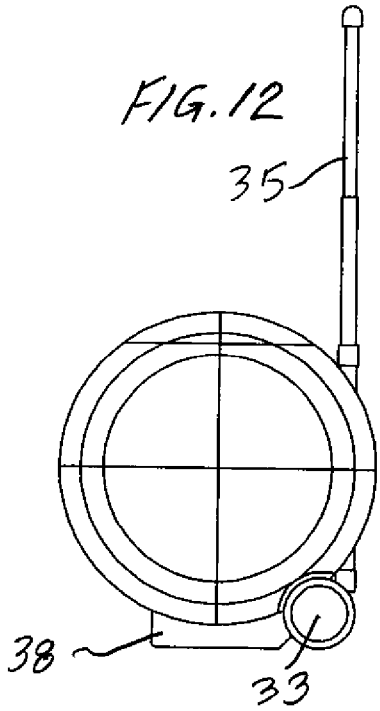
FIG. 12 is right side elevational view of the FIG. 8 apparatus.
Figure 13:
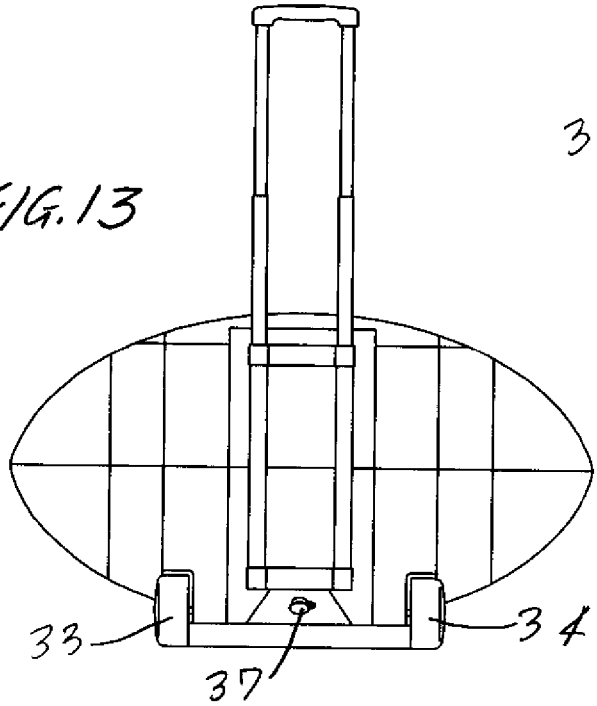
FIG. 13 is rear elevational view of the FIG. 8 apparatus.
Figure 14:
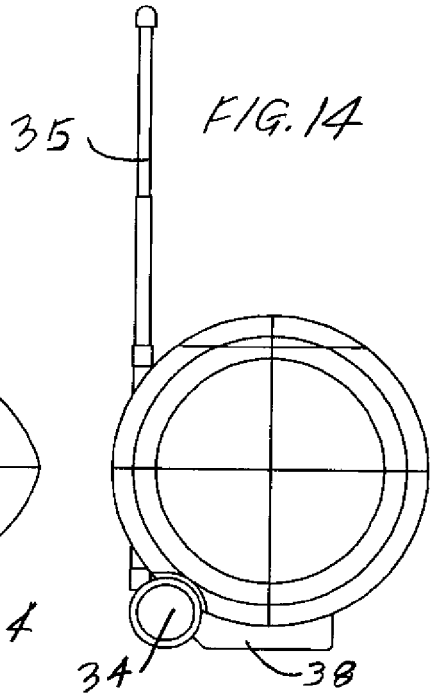
FIG. 14 is left side elevational view of the FIG. 8 apparatus.

With reference to FIGS. 8-14, there is shown a personalizable sports themed ice chest 30 in accordance with a second embodiment of the invention.

The chest 30 includes a main ice chest housing 31 having a selectively openable and closable lid member 32 which is pivotably secured to the main ice chest housing 31.

The main ice chest housing 31 and said selectively openable and closable lid member 32 are formed in a personalizable sports related shape, which in this case is the shape of a football.

Wheels 33 and 34 are rotatably secured to said main ice chest housing 31 under said main ice chest housing 31 to enable said personalizable sports themed ice chest 30 to be rolled by a user of said personalizable sports themed ice chest 30.

As best seen in FIGS. 8, 10, 11, 12 and 14, there is provided a supporting stand member 38 integral with housing 31.

A collapsible pull handle mechanism 35 is connected to said main ice chest housing 31.

There is provided one or more predetermined areas 36 and 39 for the placement thereon of a personalizable logo or emblem (not shown), such as a logo of the favorite football team of the user.

Fabrication may be of standard commercially-available ice chest material.

Alternatively, the main ice chest housing 31 and said selectively openable and closable lid member 32 may be fabricated from a renewable resource.

More particularly, the main ice chest housing 31, the selectively openable and closable lid member 32, the handle 35, the wheels 33 and 34, insulation and other components may be fabricated from a renewable resource, for example, such as corn sugar or a fibrous residue remaining after sugarcane or sorghum stalks are crushed to extract their juice.

A drain 37 is provided at the bottom of said main ice chest housing 31.

A digital recorder (not shown in FIGS. 8-14, but similar to the recorder 18 shown in FIG. 3) may be provided on the underside of said selectively openable and closable lid member 32.

The digital recorder may be provided with preset messages and the ability for the user of said personalizable sports themed ice chest 30 to record additional messages on said digital recorder.

One or more speakers (not shown in FIGS. 8-14, but similar to the speakers 19 and 29 shown in FIG. 3) may be provided on the underside of said selectively openable and closable lid member 32.

There have been illustrated in the accompanying drawings and described hereinabove only two possible unique and novel embodiments of the present invention which can be practiced and constructed in many different embodiments, configurations, materials, arrangements of components, sizes, and shapes.

A collapsible pull handle mechanism 35 is disposed in a channel 40 and is connected to said main ice chest housing 11.

Any and all such changes, modifications, variations and other uses and applications which do not depart from the spirit and scope of the present invention are therefore covered by and embraced within the present invention and the patent claims set forth hereinbelow.

The invention claimed is:

1. A personalizable sports themed ice chest, comprising:

a main ice chest housing having a selectively openable and closable lid member pivotably secured to said main ice chest housing;

said main ice chest housing and said selectively openable and closable lid member being formed in a personalizable ellipsoidal football shape;

wheels rotatably secured to said main ice chest housing under said main ice chest housing to enable said personalizable sports themed ice chest to be rolled by a user of said personalizable sports themed ice chest;

a supporting stand member integral, unitary and contiguous with and depending directly from said personalizable ellipsoidal football shaped main ice chest housing;

said supporting stand member being oriented substantially perpendicular to a central vertical axis of said personalizable ellipsoidal football shaped main ice chest housing;

said central vertical axis of said personalizable ellipsoidal football shaped main ice chest housing being oriented substantially in line with a midpoint of said supporting stand member;

said supporting stand member having an uppermost surface which is contiguous with and is integral and unitary with a lower portion of said personalizable ellipsoidal football shaped main ice chest housing;

said supporting stand member having a flat planar lowermost surface which is co-planar with a lowermost portion of said wheels;

said flat planar lowermost surface of said supporting stand member is oriented substantially perpendicular to said central vertical axis of said personalizable ellipsoidal football shaped main ice chest:

a collapsible pull handle mechanism connected to said main ice chest housing;

said personalizable ellipsoidal football shaped main ice chest housing being provided with a channel therethrough;

said collapsible pull handle mechanism is disposed in said channel in said personalizable ellipsoidal football shaped main ice chest housing; and one or more predetermined areas on said personalizable ellipsoidal football shaped main ice chest housing for the placement thereon of a logo or emblem.

2. The personalizable sports themed ice chest of claim 1, wherein:

said personalizable ellipsoidal football shaped main ice chest housing and said selectively openable and closable lid member are fabricated from a renewable resource; and a drain is provided at the bottom of said personalizable ellipsoidal football shaped main ice chest housing.

3. The personalizable sports themed ice chest of claim 2, wherein:

one or more speakers are provided on the underside of said selectively openable and closable lid member.

4. The personalizable sports themed ice chest of claim 3, including:

a digital recorder provided on the underside of said selectively openable and closable lid member.

5. The personalizable sports themed ice chest of claim 2, including:

a digital recorder provided on the underside of said selectively openable and closable lid member.

6. The personalizable sports themed ice chest of claim 1, wherein:

one or more speakers are provided on the underside of said selectively openable and closable lid member.

7. The personalizable sports themed ice chest of claim 6, including:

a digital recorder provided on the underside of said selectively openable and closable lid member.

8. The personalizable sports themed ice chest of claim 1, including:

a digital recorder provided on the underside of said selectively openable and closable lid member.

9. The personalizable sports themed ice chest of claim 8, wherein:

said digital recorder is provided with preset messages and the ability for the user of said personalizable sports themed ice chest to record additional messages on said digital recorder.

10. The personalizable sports themed ice chest of claim 1, wherein:

said personalizable ellipsoidal football shaped main ice chest housing, said selectively openable and closable lid member, said wheels, and said handle mechanism are fabricated from a renewable resource which is corn sugar or a fibrous residue remaining after sugarcane or sorghum stalks are crushed to extract their juice.

11. A personalizable sports themed ice chest, comprising:

a main ice chest housing having a selectively openable and closable lid member pivotably secured to said main ice chest housing;

said main ice chest housing and said selectively openable and closable lid member being formed in a personalizable sports related shape;

wheels rotatably secured to said main ice chest housing under said main ice chest housing to enable said personalizable sports themed ice chest to be rolled by a user of said personalizable sports themed ice chest;

a supporting stand member integral, unitary and contiguous with and depending directly from said personalizable sports shaped main ice chest housing;

said supporting stand member being oriented substantially perpendicular to a central vertical axis of said personalizable sports shaped main ice chest housing;

said central vertical axis of said personalizable sports shaped main ice chest housing being oriented co-planar with a cental medial plane of said supporting stand member;

said supporting stand member having an uppermost surface which is contiguous with and is integral and unitary with a lower portion of said personalizable sports shaped main ice chest housing;

said supporting stand member having a flat planar lowermost surface which is co-planar with a lowermost portion of said wheels;

said flat planar lowermost surface of said supporting stand member is oriented substantially perpendicular to said central vertical axis of said personalizable sports shaped main ice chest;

a collapsible pull handle mechanism connected to said main ice chest housing; and one or more predetermined areas for the placement thereon of a logo or emblem.

12. The personalizable sports themed ice chest of claim 11, wherein:

said main ice chest housing and said selectively openable and closable lid member are fabricated from a renewable resource; and a drain is provided at the bottom of said main ice chest housing.

13. The personalizable sports themed ice chest of claim 12, wherein:

one or more speakers are provided on the underside of said selectively openable and closable lid member.

14. The personalizable sports themed ice chest of claim 13, including:

a digital recorder provided on the underside of said selectively openable and closable lid member.

15. The personalizable sports themed ice chest of claim 12, including:

a digital recorder provided on the underside of said selectively openable and closable lid member.

16. The personalizable sports themed ice chest of claim 11, wherein:

one or more speakers are provided on the underside of said selectively openable and closable lid member.

17. The personalizable sports themed ice chest of claim 16, including:

a digital recorder provided on the underside of said selectively openable and closable lid member.

18. The personalizable sports themed ice chest of claim 11, including:

a digital recorder provided on the underside of said selectively openable and closable lid member.

19. The personalizable sports themed ice chest of claim 18, wherein:

said digital recorder is provided with preset messages and the ability for the user of said personalizable sports themed ice chest to record additional messages on said digital recorder.

20. The personalizable sports themed ice chest of claim 11, wherein:

said main ice chest housing, said selectively openable and closable lid member, said wheels, and said handle mechanism are fabricated from a renewable resource which is corn sugar or a fibrous residue remaining after sugarcane or sorghum stalks are crushed to extract their juice.

* * * * *